United States Patent [19]

Millard

[11] 4,442,579

[45] Apr. 17, 1984

[54] METHOD OF AND APPARATUS FOR PRODUCING VALVE ROTORS

[75] Inventor: Barry J. Millard, Reading, England

[73] Assignee: Adwest Engineering Limited, Reading, England

[21] Appl. No.: 315,743

[22] Filed: Oct. 28, 1981

[30] Foreign Application Priority Data

Dec. 12, 1980 [GB] United Kingdom ..... 8038610

[51] Int. Cl.[3] ..... B21D 53/00; B21D 53/10

[52] U.S. Cl. ..... 29/157.1 R; 72/311; 72/374; 72/416

[58] Field of Search ..... 72/293, 407, 409, 414, 72/416, 374, 376, 214, 189, 369, 372, 367, 311; 29/157.1 R

[56] References Cited

U.S. PATENT DOCUMENTS

| | | | |
|---|---|---|---|
| 530,212 | 12/1894 | Tyler | 72/376 |
| 808,001 | 12/1905 | Briede | 72/189 |
| 2,291,408 | 7/1942 | Pearson | 72/189 |
| 2,519,820 | 8/1950 | Bruegger | 29/157.3 A |
| 3,800,389 | 4/1974 | Bishop | 29/157.1 R |
| 4,103,407 | 8/1978 | Elizalde et al. | 29/157.1 R |

*Primary Examiner*—Daniel C. Crane

*Attorney, Agent, or Firm*—Bruns and Jenney

[57] ABSTRACT

The invention provides a method of and apparatus for imparting a required metering form to the longitudinal outer edges of axially extending grooves of cylindrical rotor members of rotary valves by moving an impressing tool or tools having the required metering form thereon against a said edge or edges of a rotor member or members generally in the direction of a chord extending between a point on said edge and a similar point on an adjacent edge of the nearest adjacent groove so as to displace the material of the edge being worked away from the groove.

14 Claims, 10 Drawing Figures

METHOD OF AND APPARATUS FOR PRODUCING VALVE ROTORS

BACKGROUND OF THE INVENTION

This invention relates to a method of and apparatus for producing valve rotors.

Power assisted rack-and-pinion steering gear for motor vehicles generally comprises a rotary valve for directing fluid under pressure to double acting piston and cylinder means associated with the rack so that the fluid under pressure will act on the piston of said piston and cylinder means to assist the pinion in moving the rack axially in either of its axial directions of movement and so provide power assistance in the steering of the vehicle to which the steering gear is fitted. Such rotary valves generally comprise a rotor member of generally cylindrical configuration rotatable within a valve sleeve, the rotor member being connected or connectable with a steering column so that rotary motion will be imparted to the rotor member when a steering control connected to the steering column is rotated and the rotor member and the valve sleeve each having axially extending grooves therein which cooperate to control the flow of pressure fluid through the valve according to the angular disposition of the rotor member relative to the valve sleeve, the rotor member being connected with the pinion of the rack-and-pinion steering gear by way of a torsion bar so that rotary movement of the rotor member will be transmitted to the pinion by way of the torsion bar. The torsion bar serves to bias the rotor member towards an "on-centre" position. Generally, the rotor member will have an even number, e.g., six or eight, of said axially extending grooves, whereby the grooves can be divided into coacting pairs. One groove of each pair is connected by suitable passage means with an inlet port connectable to a source of fluid under pressure and the other groove of each pair is connected by suitable passage means with an outlet port connectable to a fluid reservoir. The valve sleeve likewise generally has an equal number of said axially extending grooves pairs formed therein with one groove of each pair being connected by suitable passage means to a first cylinder port connectable to one side of the double acting piston and cylinder means of power assisted rack-and-pinion steering gear and the other axial groove of each pair being connected by suitable passage means to a second cylinder port connectable to the other side of the double acting piston and cylinder means. The axially extending grooves in the valve sleeve are offset from those in the rotor member when the valve is in on-centre position, the grooves in the valve sleeve slightly overlapping those in the rotor member so that in the on-centre position of the valve fluid under pressure entering the groove in the rotor member connected to the inlet port can pass by way of one of the grooves in the valve sleeve into the groove in the rotor member connected to the outlet port and so pass to the fluid reservoir. As the rotor member is turned in one direction or the other from its on-centre position, so communication between the or each pair of grooves in the rotor member is gradually cut-off and communication between the inlet port and one of the cylinder ports and between the outlet port and the other of the cylinder ports is gradually increased so that one side of the double acting piston-and-cylinder means is connected to the source of fluid under pressure whilst the other side thereof is connected to the fluid reservoir.

The longitudinal outer edges of the axially extending grooves in the rotor member are generally shaped to provide a required metered flow of the fluid under pressure through the valve to give required power-assist characteristics.

The shape or form which has to be imparted to the longitudinal outer edges of the axially extending grooves in the rotor member in order to obtain satisfactory power-assist characteristics is a complex curve, which may or may not have an abrupt recess or 'window' therein, such as is described for example in British Patent Specification No. 1,308,992. The only satisfactory known method of imparting the required form to the longitudinal outer edges of the rotor grooves has been to introduce a coining or pressing tool having the required form thereon radially into each rotor groove so as to displace metal from the opposed longitudinal outer edges of the rotor groove radially inwards into the groove. As can be seen, metering takes place not across the opposed longitudinal edges of each rotor groove but across the adjacent longitudinal edges of adjacent rotor grooves. Since in the known method the adjacent longitudinal outer edges of adjacent rotor grooves are contoured independently of one another, inaccuracies can occur in the spacing between said adjacent longitudinal edges of adjacent rotor grooves and these inaccuracies can have a deleterious effect on the performance of the rotary valves. Moreover, the metal which is displaced radially into the rotor grooves can cause turbulences in the fluid under pressure flowing through the valve and so can disadvantageously affect fluid flow through the valve and/or increase noise levels in the valve.

SUMMARY OF THE INVENTION

The present invention has as its object to provide a method of and apparatus for producing valve rotors which will enable the aforesaid disadvantages to be overcome.

It is a further object of the present invention to simplify the contouring of adjacent longitudinal edges of valve rotor grooves.

A still further object of the present invention is to provide apparatus for working a plurality of longitudinal edges on the grooves of a valve rotor at the same time.

Still another object of the present invention is to prevent material from entering the grooves of a valve rotor as the groove edges are being worked.

The present invention provides a method of producing a rotor member for a rotary valve, the method comprising providing a cylindrical rotor member having a plurality of axially extending grooves in the outer surface thereof and imparting to the longitudinal outer edges of said grooves a required metering form by moving a contoured impressing tool having the required metering form thereon against one outer edge to be formed generally in the direction of a chord extending between a point of the edge being formed and a similar point on the adjacent edge of the nearest adjacent groove so as to displace the metal of said edge away from the groove.

BRIEF DESCRIPTION OF THE DRAWINGS

The invention will be more particularly described with reference to the accompanying diagrammatic drawings, in which.

DESCRIPTION OF THE INVENTION

Figure 1:
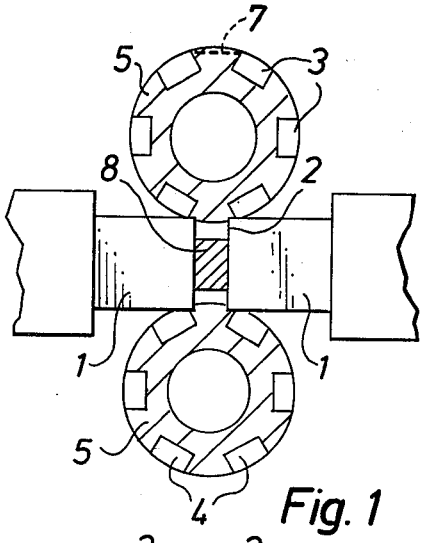
FIGS. 1 and 2 are fragmentary side and plan views respectively of a press for imparting a required metering form simultaneously to two adjacent longitudinal edges of two adjacent grooves of each of two different rotor members.

The present invention provides apparatus for imparting a required metering form to the longitudinal outer edges of a plurality of axially extending grooves in a rotor member of a rotary valve, the apparatus comprising at least one impressing tool having the required metering form thereon, a holding device for holding the rotor member, a tool holder for moving said tool against a one longitudinal edge to be formed generally in linear direction described by a chord extending between a point on the edge being formed and a similar point on an adjacent edge of the nearest adjacent groove to displace the edge material, and an edge support for engaging the adjacent edge of the nearest adjacent groove to provide support therefor whilst the worked edge is being formed.

Preferably the method of the present invention comprises imparting a required metering form simultaneously to the two edges between which said chord extends. To this end the tool supporting device of the apparatus may comprise a second impressing tool having the required metering form thereon. The second tool may be movable in the opposite direction to said first mentioned tool so that the forces exerted on the rotor member are balanced.

Where the axially extending grooves in the rotor member are so spaced around the periphery of the rotor member that the grooves on opposite sides of the rotor member are diametrically opposite one another, as is usually the case, then the apparatus may comprise a further pair of said impressing tools which are movable, when the apparatus is in use, generally in the direction of a second chord extending between the two groove longitudinal edges diametrically opposite said one edge and said adjacent edge. In this way four groove longitudinal edges may be formed simultaneously and even better balancing of the forces exerted on the rotor member obtained.

It is also possible for the apparatus to be such as to impart the required metering form simultaneously to the groove longitudinal edges of two different rotor members. To this end the or each said tool may have a second metering form thereon and said tool holder may be such as to hold two rotor members in a position where a groove longitudinal edge of each will be engaged by the or each tool.

Whether the apparatus is such as to form one, two or four groove longitudinal edges in one operation, said holding means may include an indexing unit for indexing a rotor member held thereby so as to bring the groove longitudinal edges to be formed successively one, two or four at a time to a working station or stations for forming by said tool or tools. Said indexing unit may be such as to rotate a said rotor member about its longitudinal axis and through a predetermined angle.

A stop may be provided for limiting the movement of the or each said tool generally in said chordal direction so as to limit the depth to which said metering form is impressed into the longitudinal edges of the grooves of said rotor.

The or each said impressing tool may be a simple pressing die. Preferably, however, the or each said impressing tool is a rolling die which imparts the required metering form progressively along the length of the edge being formed by a rolling action.

The metal displaced from the longitudinal edges of the grooves of the rotor members when the metering form is imparted thereto tends to be displaced to some extent at least outwards of the rotor member and the method of the present invention may include the step of removing any such radially outwardly displaced material. The removal of the displaced material may be effected in any suitable manner such as by a suitable machining, e.g., grinding, operation.

Figure 2:
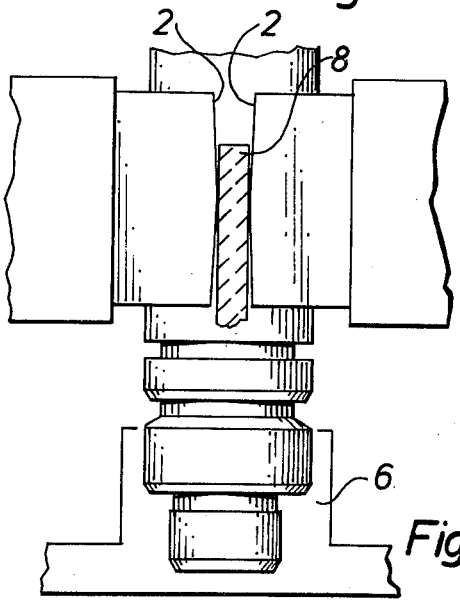

Referring to FIGS. 1 and 2 of the drawings wherein like parts are designated by like numerals, it will be seen that the apparatus illustrated therein comprises two opposed pressing tools 1 the working surface 2 of each of which has formed thereon on opposite sides thereof a required metering form which is to be imparted to the longitudinal side edges 3 of axially extending grooves 4 of two rotor members 5 of a rotary valve. Each of the rotor members 5 is held by holding means 6 (FIG. 2) which includes indexing means for rotating the rotor member about its longitudinal axis through a predetermined angle so as to bring the adjacent longitudinal side edges 3 of adjacent grooves 4 of the rotor member successively to a working station between the tools 1. The tools 1 are movable from retracted positions towards one another generally in a linear direction described by a chord, one of which is indicated by a broken line 7 in FIG. 1, extending between identical points on the adjacent side edges 3 of the nearest adjacent grooves 4 to be formed on the rotor members 5 so as to impart to said edges 3 the required metering form. A stop 8 between the opposed tools 1 limits the movement thereof towards one another and hence the extent to which metal is displaced from the adjacent side edges 3.

Figure 3:
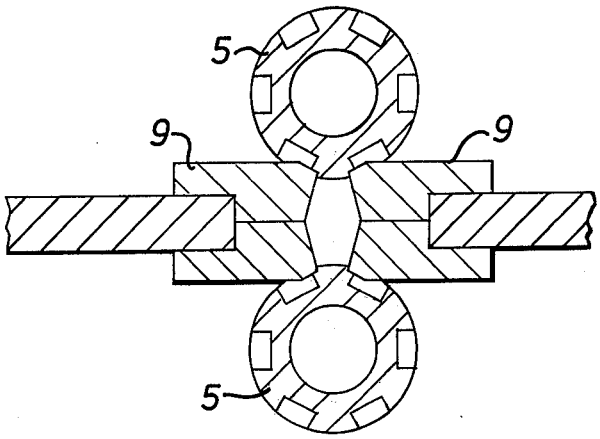
FIGS. 3 and 4 are fragmentary side and plan views respectively of a rolling die apparatus for imparting a required metering form simultaneously to two adjacent longitudinal edges of two adjacent grooves of each of two different rotor members.
Figure 4:
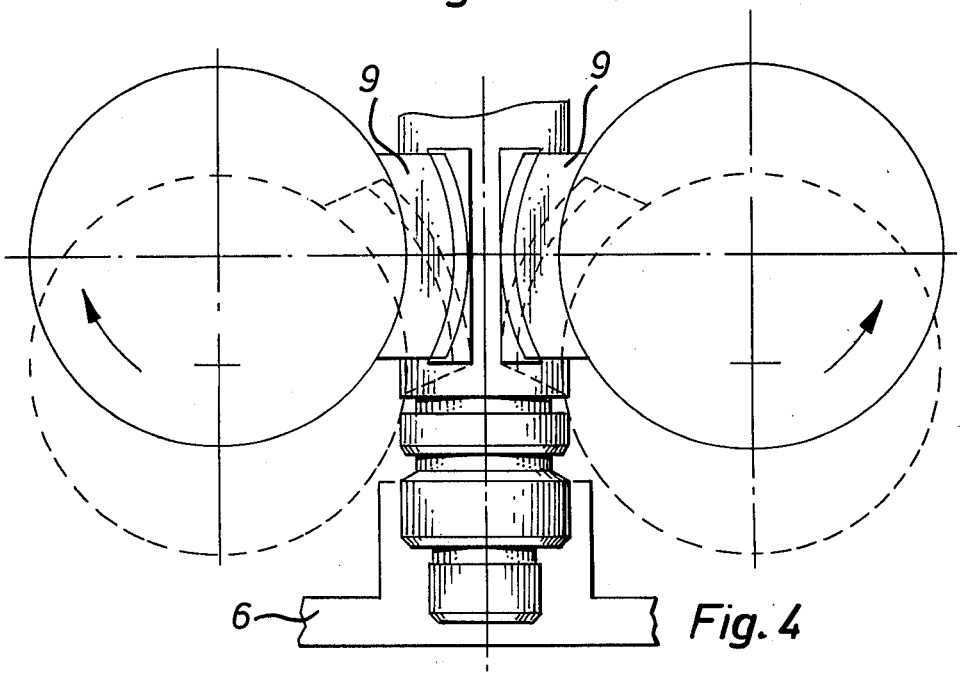

The embodiment shown in FIGS. 3 and 4 is similar to that shown in FIGS. 1 and 2 except that the opposed pressing tools 1 are replaced by opposed rolling tools 9 which as well as being mounted for movement towards one another in said chordal direction are also mounted for rolling movement longitudinally of the edges 3 so as to impart the required metering form to said edges 3 progressively along the length thereof.

Figure 5:
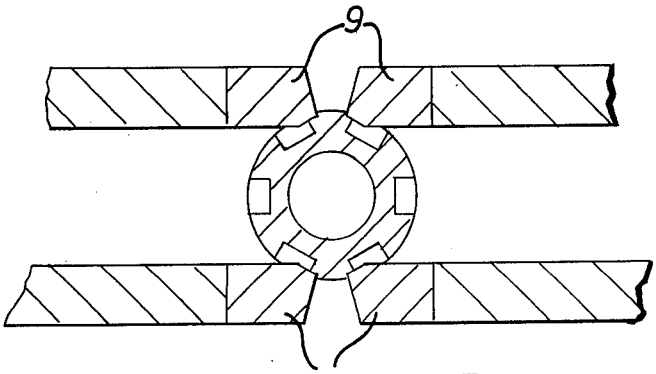
FIGS. 5 and 6 are fragmentary side and plan views respectively of a rolling die apparatus for imparting a required metering form simultaneously to the adjacent longitudinal edges of two diametrically opposed pairs of adjacent axially extending grooves of a rotor member.
Figure 6:
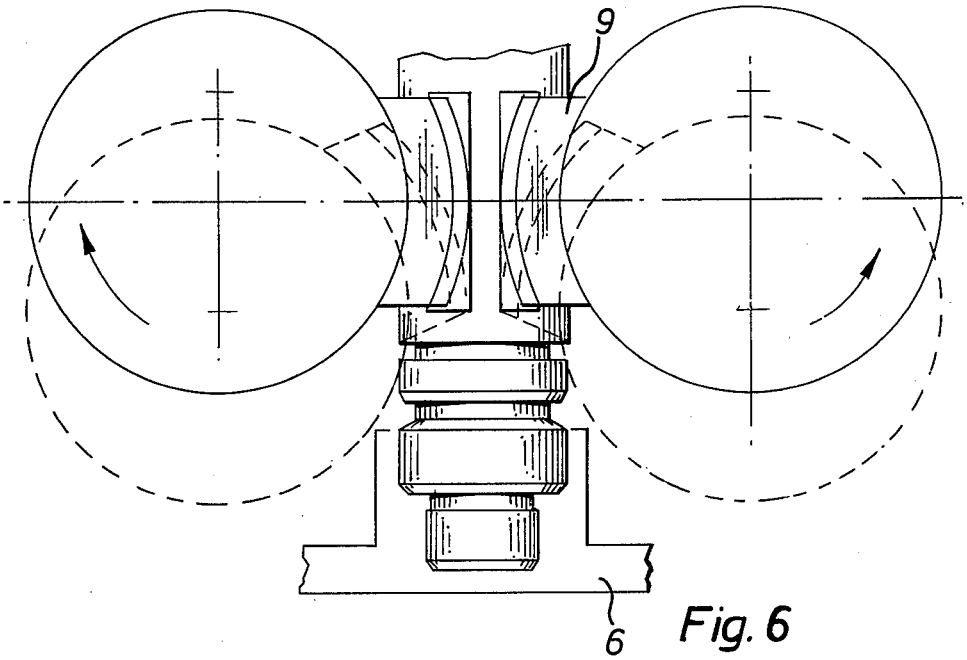

The embodiment shown in FIGS. 5 and 6 is similar to that of FIGS. 3 and 4 except that instead of a single pair of rolling tools 9 being provided for forming the adjacent side edges 3 of adjacent grooves 4 of each of two rotor members 5, two pairs of rolling tools 9 are provided which are arranged to form the adjacent side edges 3 of adjacent grooves 4 on diametrically opposite sides of a single rotor member 5.

Figure 7:
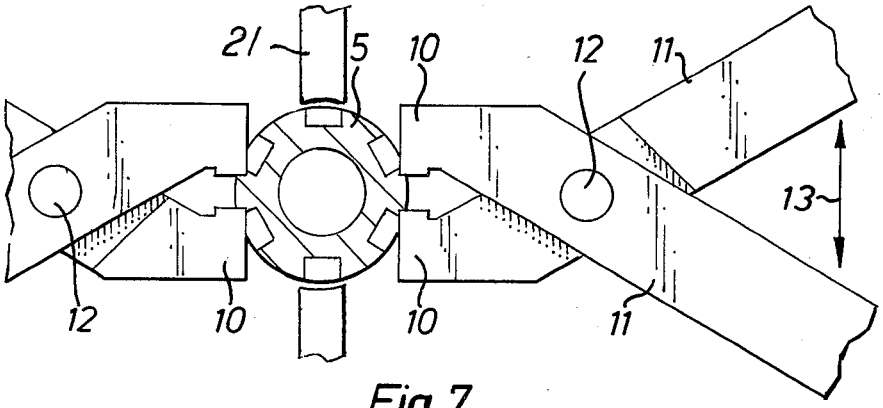
FIGS. 7 and 8 are fragmentary side and plan views respectively of a squeeze press for imparting a required metering form simultaneously to the adjacent longitudinal edges of two diametrically opposed pairs of adjacent axially extending grooves of a rotor member.
Figure 8:
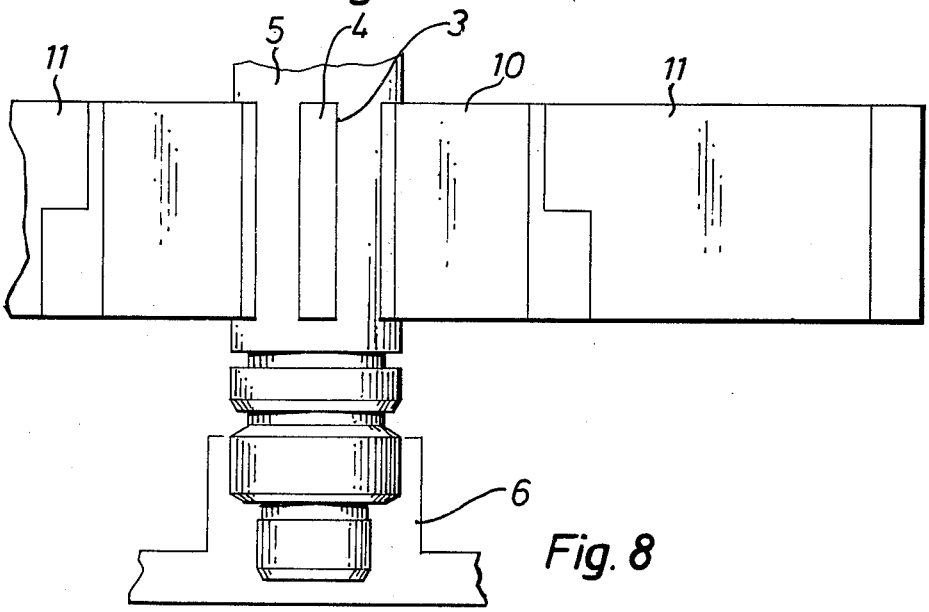

The apparatus of FIGS. 7 and 8 is again for forming the adjacent side edges 3 of adjacent grooves 4 on diametrically opposite sides of a single rotor 5. However, the two pairs of rolling tools 9 are replaced by two pairs of squeeze tools 10, the tools 10 of each pair being carried by levers 11 which are pivotally connected at 12 so that the tools 10 can be moved towards one another by applying a load as indicated by arrow 13 to the ends of the levers 11 opposite the tools 10. A pair of finishing wheels 21 is positioned adjacent to the indexing fixture which serves to finish the outer surface of the rotor after the edges have been formed.

Figure 9:
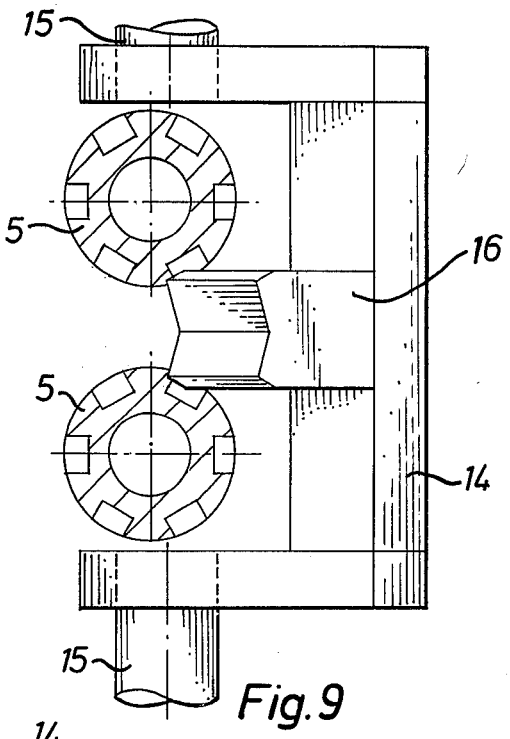
FIGS. 9 and 10 are fragmentary side and plan views respectively of a pivot press apparatus for imparting a required metering form simultaneously to two different rotor members.
Figure 10:
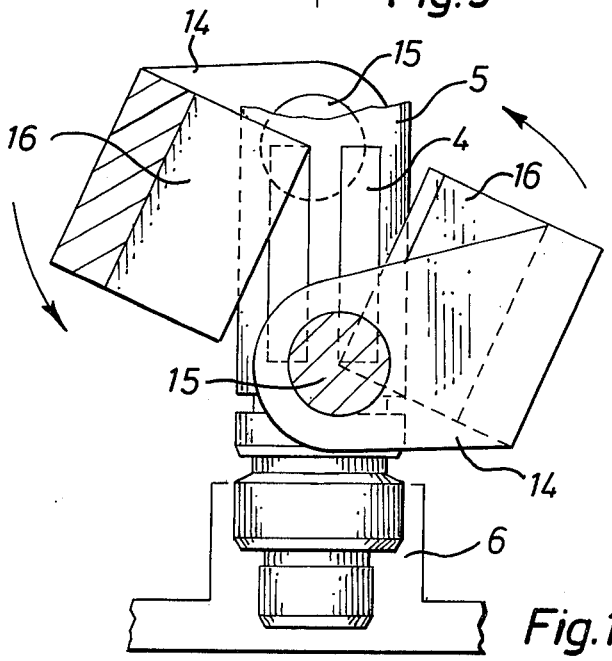

In the embodiment shown in FIGS. 9 and 10 the apparatus is, like the embodiment of FIGS. 1 and 2, adapted to impart the required metering form simultaneously to two adjacent longitudinal side edges of two adjacent grooves of each of two different rotor members 5. The apparatus of this embodiment is a pivot press comprising a pair of U-shaped carriers 14 (only one of which is shown in FIG. 9) each of which is angularly displaceable about a pair of pivot shafts 15 and each of which carries a rolling tool 16 for imparting the required metering form to the adjacent longitudinal side edges 3 of adjacent grooves 4 of a pair of rotor members 5.

It will be understood that the various embodiments described above are merely exemplary of different kinds of apparatus according to the invention. It will also be understood that various modifications of the embodiments illustrated are possible, such as by modifying the embodiments of FIGS. 1 and 2, or 3 and 4, or 9 and 10, for forming the groove side edges 3 of a single rotor 5 only or by modifying the embodiment of FIGS. 5 and 6 for simultaneously forming the groove side edges 3 of two or more rotor members 5.

It will be apparent to those skilled in the art that since the present invention enables the adjacent longitudinal edges 3 of adjacent grooves 4 over which metering takes place to be formed simultaneously the inaccuracies which occur with the hereinbefore described known method can be eliminated. Moreover, since the material which is displaced from the longitudinal edges 3 is displaced to a large degree radially outwards, and not radially inwards into the grooves 4 as in the known method, the displaced material can be readily removed from the rotor member and so cannot cause turbulences which affect fluid flow through a rotary valve of which the rotor member forms part and/or increase noise levels in the valve. Moreover, the method and apparatus of the invention have further advantages in that the forces exerted on the rotor member or members during the forming operation can be readily balanced and two or even more rotor members can have adjacent longitudinal edges of adjacent grooves of each thereof formed at one and the same time in a single operation.

While this invention has been described with reference to the details as set forth above, it is not limited to the specific structure as disclosed and the invention is intended to cover any modifications or changes as may come within the scope of the following claims.

I claim:

1. Apparatus for imparting a required metering form to the longitudinal outer edges of a plurality of axially extending and circumferentially spaced grooves formed in a rotor member of a rotary valve with arcuate segments extending between the circumferentially spaced grooves, the apparatus comprising at least one impressing tool having the required metering form thereon, holding means for supporting a said rotor member, means for moving said tool into deforming contact against a one longitudinal edge to be formed along a path of travel described by a chord extending between said one edge and the adjacent edge of the nearest adjacent groove to displace the material of said one edge, supporting means for engaging said adjacent edge of the nearest adjacent groove to provide support therefor whilst said edge is being formed, and indexing means for said holding means for positioning each arcuate segment of the rotor member between said impressing tool and said supporting means so that said impressing tool travels into a respective groove.

2. Apparatus according to claim 1, wherein said supporting means comprises a second impressing tool having the required metering form thereon for imparting the required metering form to said adjacent edge of the nearest adjacent groove, and means for moving said second impressing tool in an opposite direction to said first mentioned impressing tool.

3. Apparatus according to claim 1, wherein said at least one impressing tool has a second metering form thereon and said holding means is such as to hold two rotor members in a position wherein a groove longitudinal edge of each will be engaged by the at least one impressing tool.

4. Apparatus according to claim 3, comprising first and second said impressing tools each having first and second metering forms thereon, said first and second impressing tools being movable in opposite directions to one another to impart the required metering form simultaneously to said one edge and said adjacent edge of both rotor members.

5. Apparatus according to claim 1, wherein said holding means comprises indexing means for indexing the rotor member about its longitudinal axis, whereby to bring the groove longitudinal edges to be formed of a rotor member successively at least one at a time to at least one work station for forming by said at least one impressing tool.

6. Apparatus according to claim 1, comprising stop means for limiting the movement of said at least one impressing tool generally in said chordal direction whereby to limit the depth to which said metering form is impressed into the longitudinal edges of the grooves of a said rotor member.

7. The method of producing a rotor member for a rotary valve, the method including the steps of providing a cylindrical rotor member having a plurality of axially disposed and circumferentially spaced grooves formed in the outer surface thereof with each groove being defined by a pair of longitudinal outer edges on the periphery of the cylindrical rotor member whereby the longitudinal outer edge on one groove is generally parallel with the adjacent edge on the next adjacent groove, contacting two adjacent outer edges on two adjacent grooves with a pair of coacting impressing tools by positioning said tool in said grooves, each of said tools having a required metering form on its contacting surface, moving the tools simultaneously towards each other along a path of travel described by a chord that passes through the two adjacent edges whereby material in the contact region is displaced generally inwardly and upwardly away from the groove.

8. A method according to claim 7, which comprises indexing said rotor members so as to bring the groove longitudinal edges to be formed successively at least one at a time to at least one work station for forming by at least one said impressing tool.

9. A method according to claim 8, wherein said rotor member is indexed by rotating it about its longitudinal axis and through a predetermined angle.

10. A method according to claim 7, which comprises using stop means to limit the movement of said impressing tools in said chordal direction and hence limit the depth to which said metering form is impressed into said at least one edge.

11. A method according to claim 7, which comprises removing any material of the rotor member which is displaced outwardly when the metering form is imparted to said outer edges.

12. A method according to claim 11, wherein said radially displaced material is removed by grinding.

13. A method of producing a rotor member for a rotary valve, the method comprising providing a pair of cylindrical rotor members each having a plurality of axially extending and circumferentially spaced grooves in the outer surface thereof with each groove being defined by a pair of longitudinal edges on the periphery of each cylindrical rotor member, holding each rotor member so that a longitudinal edge of a groove on each rotor can be engaged by a single impressing tool, engaging the longitudinal edge of a groove on each rotor member by said tool, imparting to the edges of each tool engaged groove a required metering form by moving the impressing tool having the form thereon against the said edges to be formed generally in the direction of a chord extending between each edge and an adjacent edge of the nearest adjacent groove on each rotor so as to displace the material of said tool contacted edges.

14. A method according to claim 13 which comprises providing a second impressing tool having first and second said required metering forms thereon and moving said second impressing tool simultaneously with and in opposite direction to said first mentioned impressing tool against the adjacent groove longitudinal edges of the nearest adjacent grooves of the two rotor members, whereby to apply the required metering form also to said adjacent groove longitudinal edges and balance the forces exerted on the pair of rotor members.

* * * * *